US012733737B2

(12) United States Patent
Chen

(10) Patent No.: US 12,733,737 B2
(45) Date of Patent: Sep. 15, 2026

(54) SWING CHAIR

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 115 days.

(21) Appl. No.: 18/823,544

(22) Filed: Sep. 3, 2024

(65) Prior Publication Data

US 2026/0060425 A1 Mar. 5, 2026

(51) Int. Cl.
*A47C 3/025* (2006.01)
*A47C 4/02* (2006.01)

(52) U.S. Cl.
CPC ..... *A47C 3/0255* (2013.01); *A47C 4/02* (2013.01)

(58) Field of Classification Search
CPC ..... A47C 3/0255; A47C 4/02; A63G 9/00; A63G 9/12; A63G 9/14; A63G 9/02
USPC ..... 297/463.2, 277–278
See application file for complete search history.

(56) References Cited

U.S. PATENT DOCUMENTS 1,417,443 A * 5/1922 Baugher ..... A47C 3/0255 297/381
4,351,524 A * 9/1982 Gomes ..... A47C 3/0255 248/188
4,790,599 A * 12/1988 Goldman ..... A47C 3/03 297/282
5,657,783 A * 8/1997 Sisko ..... A61H 3/00 135/73
5,957,780 A * 9/1999 Grazioli ..... A47C 3/03 472/125
6,019,427 A * 2/2000 Combest ..... B60P 3/36 297/277
6,383,085 B1 * 5/2002 Tseng ..... A47C 7/66 5/128
6,508,444 B1 * 1/2003 Tseng ..... A63G 9/00 135/124
6,585,319 B2 * 7/2003 Tseng ..... A47C 3/0255 297/277
6,648,768 B1 * 11/2003 Tseng ..... A47C 3/0255 472/125
6,672,665 B1 * 1/2004 Tseng ..... A47C 3/0255 297/376

(Continued)

FOREIGN PATENT DOCUMENTS

CN 213962529 U 8/2021
CN 215837979 U 2/2022
CN 117918657 A 4/2024

*Primary Examiner* — Adam J Waggenspack
(74) *Attorney, Agent, or Firm* — Nitin Kaushik

(57) ABSTRACT

The present invention relates to the technical field of swing chairs, and in particular, to a swing chair. The swing chair includes a ceiling, where the ceiling is fixed through a support frame, a bottom portion of the support frame is embedded in a foot pad block, two ends of a hanging chair are hoisted through hanging rods, an upper end of each hanging rod is connected to an inclined beam in the ceiling through a hanging spring, and a front support frame and a rear support frame in the support frame are both detachable. All parts of the swing chair are mutually nested, and are connected and fixed through a screw rod, which is convenient to disassemble and storage, reduces packaging space and transportation space, and reduces packaging and transportation costs.

6 Claims, 11 Drawing Sheets

(56) References Cited

U.S. PATENT DOCUMENTS

| | | | | |
|---|---|---|---|---|
| 6,786,829 | B1 * | 9/2004 | Tseng | A63G 9/00 297/368 |
| 6,802,783 | B1 * | 10/2004 | Tseng | A47C 3/0255 297/216.16 |
| 6,857,701 | B1 * | 2/2005 | Liu | A47C 3/0255 297/282 |
| 7,367,895 | B2 * | 5/2008 | Tseng | A47C 3/0255 472/125 |
| 8,684,458 | B2 * | 4/2014 | Lee | A47C 7/407 297/277 |
| 9,670,033 | B1 * | 6/2017 | Lieberman | E06B 9/581 |
| 2005/0173949 | A1 * | 8/2005 | Hart | A47C 3/0255 297/171 |
| 2016/0206096 | A1 * | 7/2016 | Chen | A47C 7/66 |
| 2024/0306819 | A1 * | 9/2024 | Chen | A47C 3/0255 |

* cited by examiner

SWING CHAIR

TECHNICAL FIELD

The present invention relates to the technical field of swing chairs, and in particular, to a swing chair.

BACKGROUND

A swing chair is a piece of leisure furniture, and is usually designed for an outdoor environment such as a garden, a terrace or a balcony, and an indoor unit. They may provide a comfortable seat experience, allowing a user to swing while enjoying outdoor scenery.

An existing swing chair is designed to be large in size, and a risk of overturning may occur during swinging. In order to improve stability of the swing chair, a swing chair frame is fixed by welding and riveting, thereby increasing carrying and disassembling costs of the swing chair. The swing chair itself has swinging performance, and when the elderly, children and people with reduced mobility to take, other potential safety hazards can be caused if they are not stabilized or seated.

Therefore, the present applicant provides a swing chair, for solving the problems raised in the above background.

SUMMARY

The present invention is intended to provide a swing chair to solve problems that an existing swing chair is large in size and is inconvenient to package, transport and disassemble; and to prevent other potential safety hazards from being caused when the elderly, children and people with reduced mobility take.

To resolve the foregoing technical problem, the present invention provides a swing chair, including a ceiling, where the ceiling is fixed through a support frame, a bottom portion of the support frame is embedded in a foot pad block, two ends of a hanging chair are hoisted by means of hanging rods, an upper end of each hanging rod is connected to an inclined beam in the ceiling through a hanging spring; and a front support frame and a rear support frame in the support frame are both detachable.

A further improvement of the technical solution of the present invention lies in that: the front support frame further includes an upper section support rod and a lower section support rod which are assembled with each other in a nested manner and are fixed through a screw rod.

A further improvement of the technical solution of the present invention lies in that: the support frame is formed in a herringbone shape by the front support frame and the rear support frame, the front support frame and the rear support frame of the support frame have the same size and structure.

A further improvement of the technical solution of the present invention lies in that: a longitudinal mesh plate is arranged between the front support frame and the rear support frame, a placing plate is arranged at a top portion of the longitudinal mesh plate, and two ends of the longitudinal mesh plate are respectively connected to the front support frame and the rear support frame through screw rods.

A further improvement of the technical solution of the present invention lies in that: a ceiling frame is arranged in the ceiling, the ceiling frame is transversely supported through a ceiling cross beam, vertical beams are arranged below two ends of the ceiling cross beam, each vertical beam is fixed between the front support frame and the rear support frame through a screw rod in an abutting manner, an inclined beam is arranged in an included angle between the vertical beam and the ceiling cross beam, and the hanging spring is fixed by the inclined beam.

A further improvement of the technical solution of the present invention lies in that: the two hanging rods form a herringbone shape and are respectively fixed to a side hanging frame through a hole, the side hanging frame is of an inverted U shape, and a hanging frame cross beam for supporting is arranged in the side hanging frame.

A further improvement of the technical solution of the present invention lies in that: a seat plate frame and a backrest frame are respectively fixed to two ends of the side hanging frame through screw rods, a seat plate and a backrest are respectively fixed to the seat plate frame and the backrest frame, and the seat plate and the backrest are made of a soft material.

A further improvement of the technical solution of the present invention lies in that: the backrest frame is fixed to the side hanging frame through a hand-screwed nut, and a user rotates the hand-screwed nut to flatten the backrest frame.

A further improvement of the technical solution of the present invention lies in that: a fixed hole is arranged on an inner side of the lower section support rod, one end of a locking rod is nested in the fixed hole, and the other end of the locking rod is nested in a fixed through hole arranged on the backrest frame.

A further improvement of the technical solution of the present invention lies in that: the locking rod is a Z shape, one end of the locking rod sleeved on the fixed hole only rotates, and one end of the locking rod sleeved on the fixed through hole can be opened through a butterfly nut, so as to prevent the backrest frame from rising and the hanging chair from being integrally fixed and swinging.

A further improvement of the technical solution of the present invention lies in that: a U-shaped beam is arranged between the front support frame and the rear support frame in the support frame, one end of a limiting rod is fixedly arranged in a middle portion of the U-shaped beam, and the other end of the limiting rod is embedded into a limiting groove.

A further improvement of the technical solution of the present invention lies in that: the two hanging rods form a herringbone shape, a limiting beam is fixedly arranged between the two hanging rods, a limiting groove is arranged on an inner side surface of the limiting beam, and the limiting groove is adapted to sliding of the limiting rod.

The present invention has the following beneficial effects after adopting the above technical solutions:

1. According to the swing chair provided by the invention, all parts of the swing chair are mutually nested, and are connected and fixed through a screw rod. The upper section support rod and the lower section support rod are used in a nested manner, which is convenient to disassemble and storage, reduces packaging space and transportation space, and reduces packaging and transportation costs.

2. According to the swing chair provided by the invention, the backrest is fixed to the support frame through the locking rod, so that the backrest is prevented from shaking when being laid flat, and the stability of the hanging chair is improved.

3. According to the swing chair provided by the invention, the locking rod is arranged to fix the hanging chair, so that the shaking of the hanging chair is limited, and other potential safety hazards are prevented from being caused when the elderly, children and people with reduced mobility take.

4. According to the swing chair provided by the invention, the U-shaped beam and the limiting beam are respectively arranged between the support frame and the hanging rod, the limiting rod on the U-shaped beam is adapted to the limiting groove on the limiting beam, when the hanging chair swings, the limiting rod moves in the limiting groove, the swing angle and amplitude of the hanging chair are limited, so that the safety coefficient of the hanging chair during swinging is increased.

BRIEF DESCRIPTION OF THE DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Figure 1:
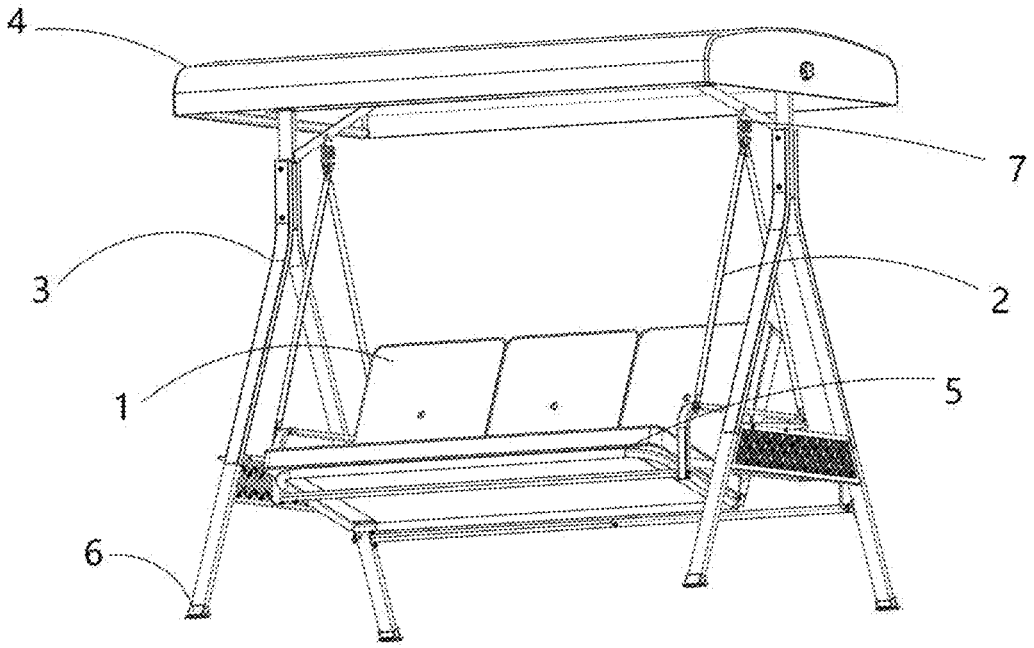
FIG. 1 is an overall schematic diagram of a swing chair.
Figure 2:
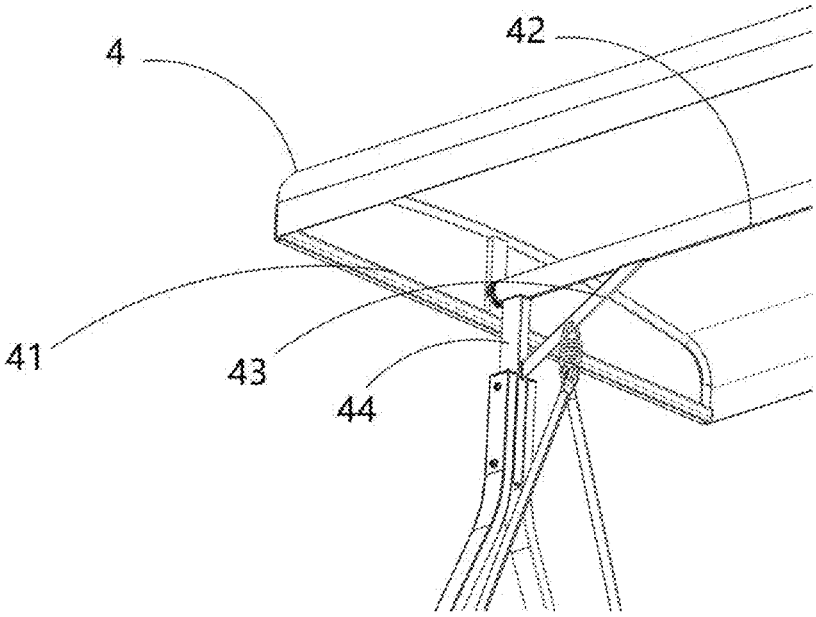
FIG. 2 is a schematic structural diagram of a ceiling in FIG. 1.
Figure 3:
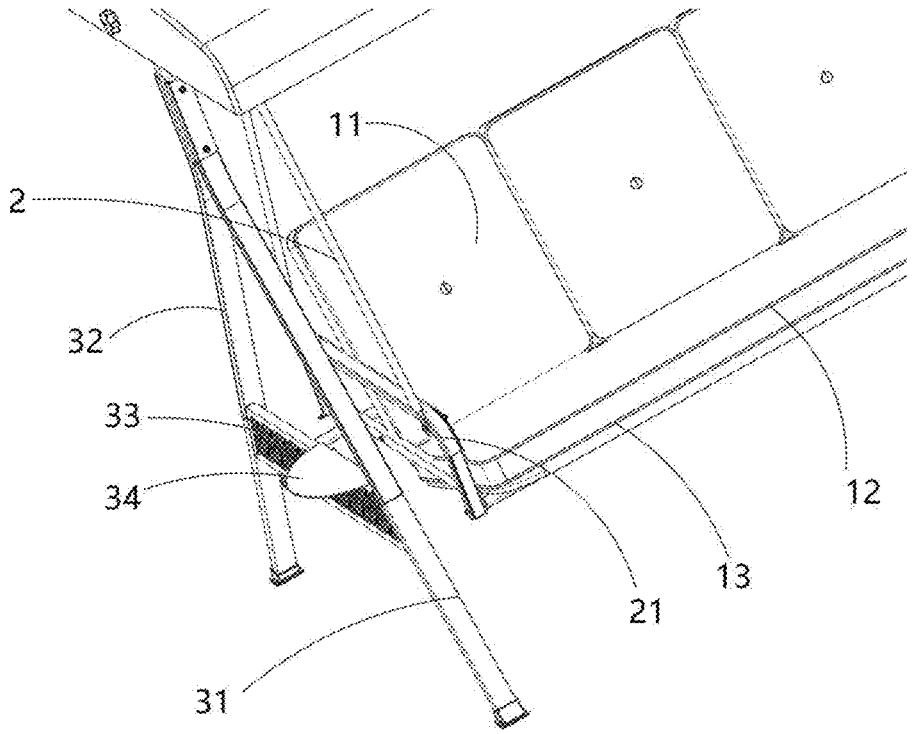
FIG. 3 is a schematic structural diagram of a hanging chair and a support frame.
Figure 4:
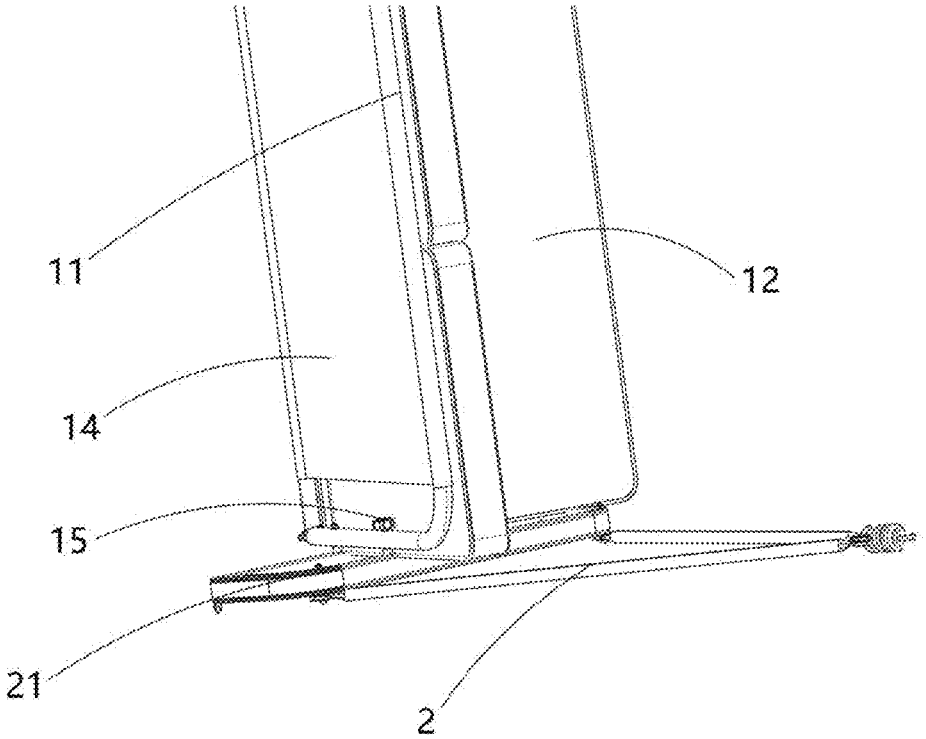
FIG. 4 is a schematic structural diagram of a hanging chair and a hanging rod.
Figure 5:
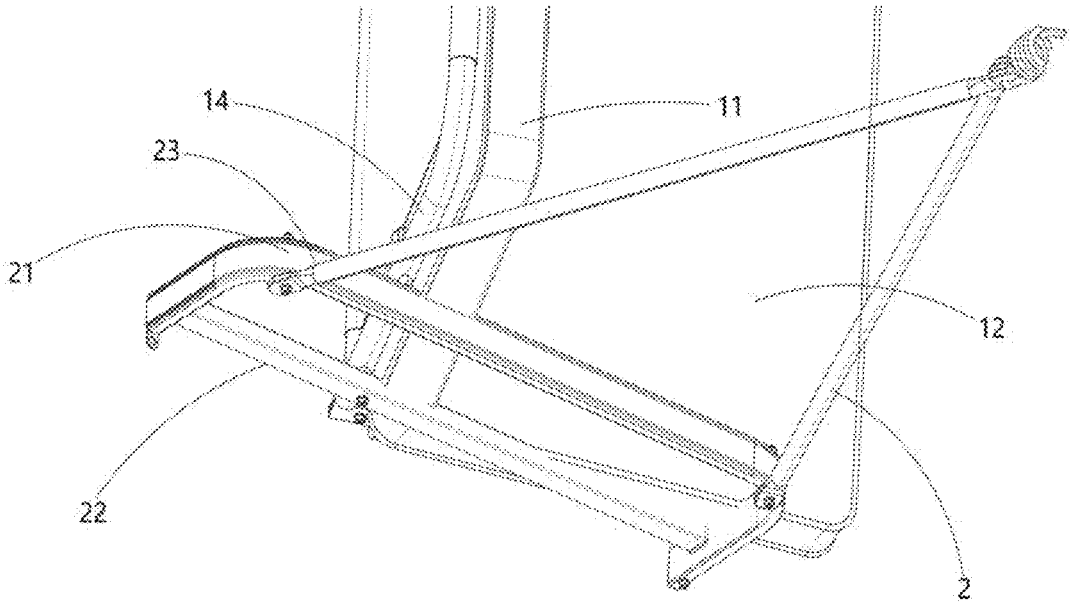
FIG. 5 is a schematic structural diagram of a part of a hanging rod.

Reference numerals in the drawings: 1. hanging chair; 11. backrest; 12. seat plate; 13. seat plate frame; 14. backrest frame; 141. fixed through hole; 15. hand-screwed nut; 2. hanging rod; 21. side hanging frame; 22. hanging frame cross beam; 23. hole; 24. limiting beam; 240. limiting groove; 3. support frame; 31. front support frame; 32. rear support frame; 33. longitudinal mesh plate; 34. placing plate; 35. upper section support rod; 36. lower section support rod; 37. fixed hole; 38. cross beam; 39. U-shaped beam; 390. limiting rod; 4. ceiling; 41. ceiling frame; 42. ceiling cross beam; 43. inclined beam; 44. vertical beam; 6. foot pad block; 7. hanging spring; 8. locking rod; 81. butterfly nut.

DETAILED DESCRIPTION OF THE EMBODIMENTS

An explicit and complete description of the technical solution in the present invention is given below in conjunction with the accompanying drawings. Apparently, the described embodiments are part not all of the embodiments of the present invention. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Embodiment 1

As shown in FIG. 1 to FIG. 11, this embodiment provides a swing chair, including a ceiling 4, where the ceiling 4 is fixed through a support frame 3, a bottom portion of the support frame 3 is embedded in a foot pad block 6, two ends of a hanging chair 1 are hoisted through hanging rods 2, an upper end of each hanging rod 2 is connected to an inclined beam 43 in the ceiling 4 by means of a hanging spring 7; and a front support frame 31 and a rear support frame 32 in the support frame 3 are both detachable. In this embodiment, the ceiling 4 is support through the support frame 3, and the ceiling is used for sun shading and rain sheltering of the hanging chair 1. A ceiling frame 41 is arranged in the ceiling 4, the ceiling frame 41 is transversely supported through a ceiling cross beam 42, vertical beams 44 are arranged below two ends of the ceiling cross beam 42, an inclined beam 43 is arranged in an included angle between the vertical beam 44 and the ceiling cross beam 42, and the hanging spring 7 is fixed by the inclined beam 43. The ceiling frame 41 is arranged on a bottom surface of the ceiling 4 to open the whole ceiling 4 to form an inner cavity. A structure of the ceiling cross beam 42 in the ceiling frame for transversely supporting the ceiling improves the stability of the ceiling. Meanwhile, the vertical beams 44 are arranged at two ends of the ceiling cross beam 42 and the ceiling frame 41, and the inclined beam 43 is arranged in an included angle between the vertical beam 44 and the ceiling cross beam 42, so as to improve the overall firmness and stability of the ceiling 4. A through hole is arranged on the inclined beam 43 for fixing the hanging spring 7, the hanging spring 7 is connected to a top portion of the hanging rod 2, the two hanging rods 2 form a herringbone shape and is respectively fixed to a side hanging frame 21 through a hole 23, the side hanging frame 21 is of an inverted U shape, and a hanging frame cross beam 22 used for supporting is arranged in the side hanging frame. The bottom portions of the two herringbone-shaped hanging rods are respectively connected to a front portion and a rear portion of the side hanging frame 21. A seat plate frame 13 and a backrest frame 14 are respectively fixed to two ends of the side hanging frame 21 through screw rods, so that the hanging rod and the hanging chair form a whole. By swinging the hanging rod, an upper portion of the hanging rod rotates on a hanging spring buckle, and then the side hanging frame at a lower portion of the hanging rod swings back and forth. A seat plate 12 and a backrest 11 are respectively fixed to the seat plate frame 13 and the backrest frame 14, so that the overall stress of the side hanging frame and the hanging chair is increased, and the hanging chair is prevented from being damaged and falling off. The seat plate 12 and the backrest 11 are made of a soft material. The soft material is a preferred sponge, and leather is wrapped on an outer surface of the sponge, so that the sponge is prevented from being wetted by rainwater, and meanwhile, the comfort of the seat plate is improved.

Further, vertical beams 44 are fixedly arranged at the two ends of the ceiling cross beam 42, a lower portion of each vertical beam 44 is fixed between the front support frame 31 and the rear support frame 32 through a screw rod in an abutting manner, the front support frame 31 further includes an upper section support rod 35 and a lower section support rod 36 which are assembled with each other in a nested manner and are fixed through a screw rod, so that the firmness and stability of the ceiling cross beam 42 are further enhanced. The support frame 3 is formed in a herringbone shape by the front support frame 31 and the rear support frame 32, the front support frame 31 and the rear support frame 32 of the support frame have the same size and structure, the rear support frame 32 on the left and the rear support frame 32 on the right are connected through a cross beam 38, so that the stability of the rear support frame on the left and the rear support frame on the right are improved. The arrangement of the herringbone shape increases the included angle between the front support frame 31 and the rear support frame 32, so that the stability of the support rod is improved. A longitudinal mesh plate 33 is arranged between the front support frame 31 and the rear support frame 32, a placing plate 34 is arranged at a top portion of the longitudinal mesh plate 33, and two ends of the longitudinal mesh plate 33 are respectively connected to the front support frame 31 and the rear support frame 32 through screw rods. The arrangement of the longitudinal mesh plate improves the stability of the front support frame 31 and the rear support frame 32, and meanwhile, the placing plate is arranged on the longitudinal mesh plate, so that it is convenient for a user to place an article on the placing plate. The front support frame 31 and the rear support frame 32 are both formed by the upper section support rod 35 and the lower section support rod 36 which are assembled with each other in a nested manner. The arrangement of the two support frames reduces the length of the support frame, so that it is convenient for the user to package and transport. In this embodiment, all parts of the swing chair are mutually matched, and are connected and fixed through screw rods, so that it is convenient for the user to disassemble and store, packaging space and transportation space are reduced, and packaging and transportation costs are reduced.

In this embodiment, a fixed hole 37 is arranged on an inner side of the lower section support rod 36 in the rear support frame 32, one end of a locking rod 8 is nested in the fixed hole 37, and the other end of the locking rod 8 is nested in a fixed through hole 141 arranged on the backrest frame 14. The locking rod 8 is arranged to fix the hanging chair, so that the hanging chair cannot shake. The locking rod 8 is in a Z shape, one end of the locking rod sleeved on the fixed hole 37 only rotates, and one end of the locking rod sleeved on the fixed through hole 141 can be fixed through a butterfly nut 81. The user removes the butterfly nut 81 to enable the locking rod to be in a straightened and released state, and when the user needs to fix the hanging chair, the locking rod is straightened, and after a hook penetrates into the fixed through hole 141, the butterfly nut 81 is rotated to be fixed. When the user releases the hanging chair, the butterfly nut 81 is rotated to exit one end of the locking rod 8, the other end of the locking rod rotates in the fixed hole, but does not fall off, and then the butterfly nut is fitted onto the locking rod. According to the embodiment of the present invention, the locking rod is innovatively designed, and the usage function of the hanging chair is increased. Meanwhile, the hanging chair is fixed, and other potential safety hazards are prevented from being caused when the elderly, children and people with reduced mobility take.

Embodiment 2

Figure 6:
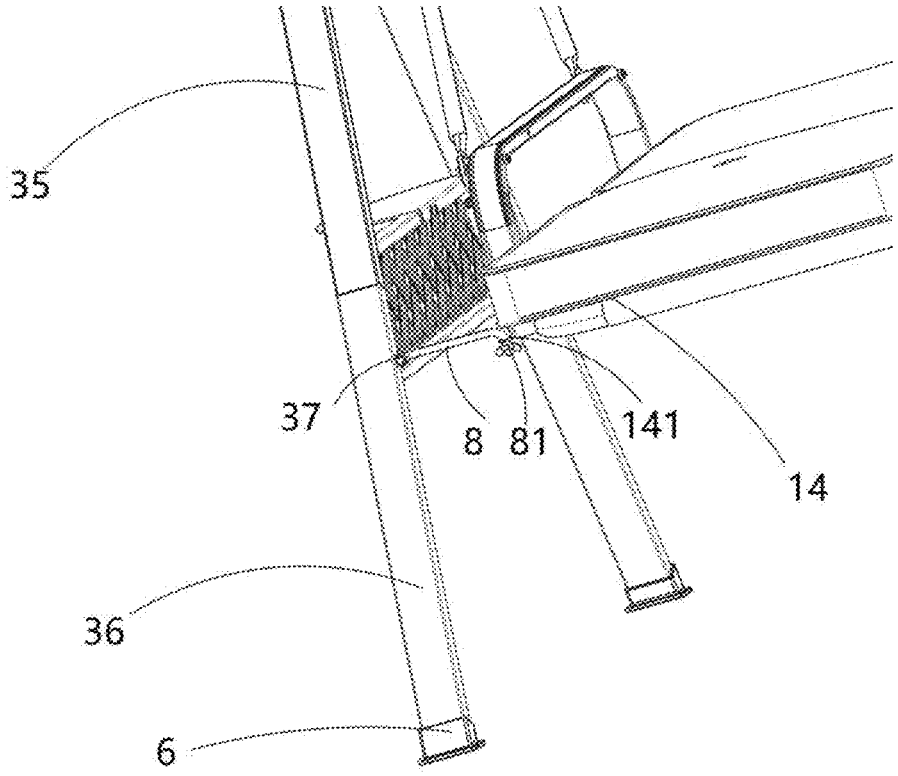
FIG. 6 is a schematic structural diagram of a support frame and a locking rod.
Figure 7:
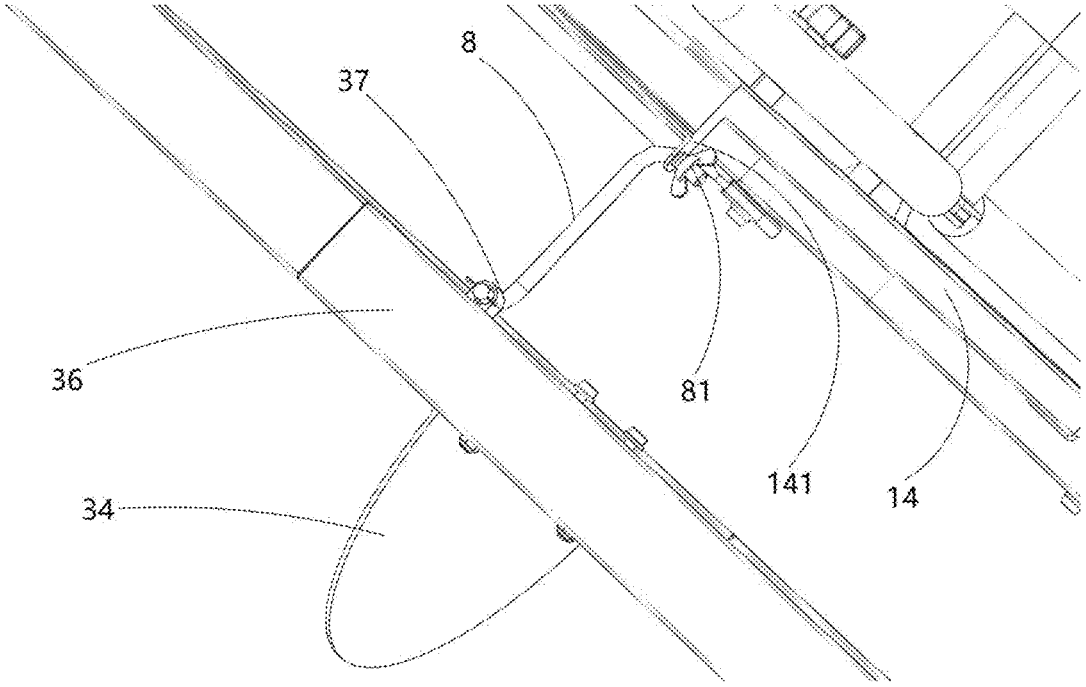
FIG. 7 is a schematic structural diagram of a locking rod.
Figure 8:
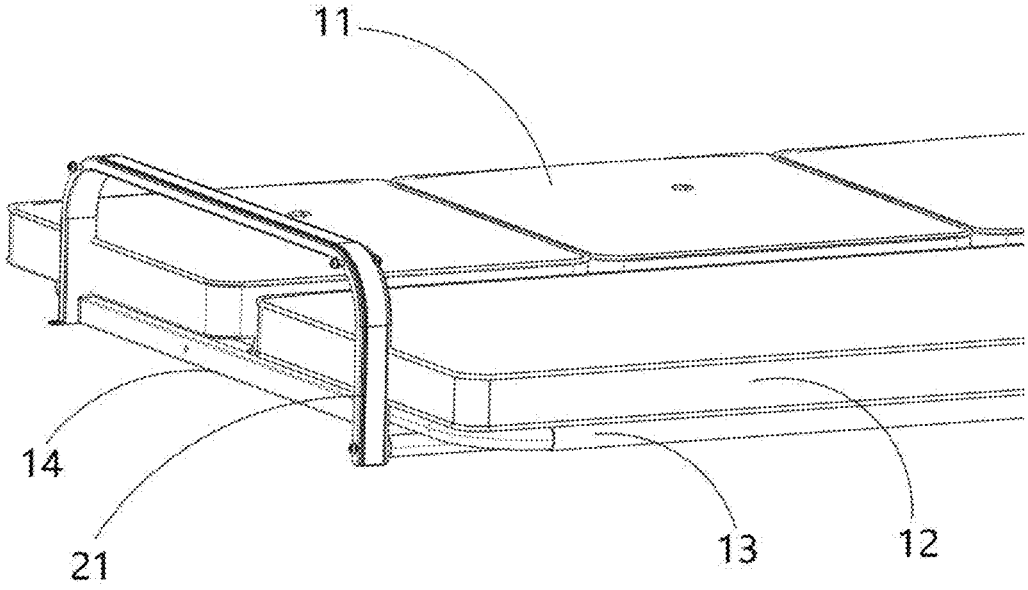
FIG. 8 is a schematic structural diagram of a hanging chair in a swing chair during flattening.

As shown in FIG. 6 to FIG. 8, this embodiment provides a swing chair, including a side hanging frame 21, where the backrest frame 14 is fixed to the side hanging frame 21 through a hand-screwed nut 15, and a user rotates the hand-screwed nut to flatten the backrest frame. The user turns the backrest frame 14 backward into a plane by rotating the hand-screwed nut 15 on the side hanging frame 21, so that the usage function of the hanging chair is increased. Meanwhile, a fixed hole 37 is arranged on an inner side of the lower section support rod 36 in the rear support frame 32, one end of a locking rod 8 is nested in the fixed hole 37, and the other end of the locking rod 8 is nested in a fixed through hole 141 arranged on the backrest frame 14. The locking rod 8 is arranged to fix the hanging chair, so that the hanging chair cannot shake. The locking rod 8 is in a Z shape, one end of the locking rod sleeved on the fixed hole 37 only rotates, and one end of the locking rod sleeved on the fixed through hole 141 can be fixed through a butterfly nut 81. The user removes the butterfly nut 81 to enable the locking rod to be in a straightened and released state, and when the user needs to fix the hanging chair, the locking rod is straightened, and after a hook penetrates into the fixed through hole 141, the butterfly nut 81 is rotated to be fixed. When the user releases the hanging chair, the butterfly nut 81 is rotated to exit one end of the locking rod 8, the other end of the locking rod rotates in the fixed hole, but does not fall off, and then the butterfly nut is fitted onto the locking rod. According to the embodiment of the present invention, the locking rod is innovatively designed, and the usage function of the hanging chair is increased. Meanwhile, the hanging chair is fixed, and other potential safety hazards are prevented from being caused when the elderly, children and people with reduced mobility take. Compared with Embodiment 1, a structure, a size, a positional relationship and a connection relationship of other parts in Embodiment 2 are the same as those in Embodiment 1.

Embodiment 3

Figure 9:
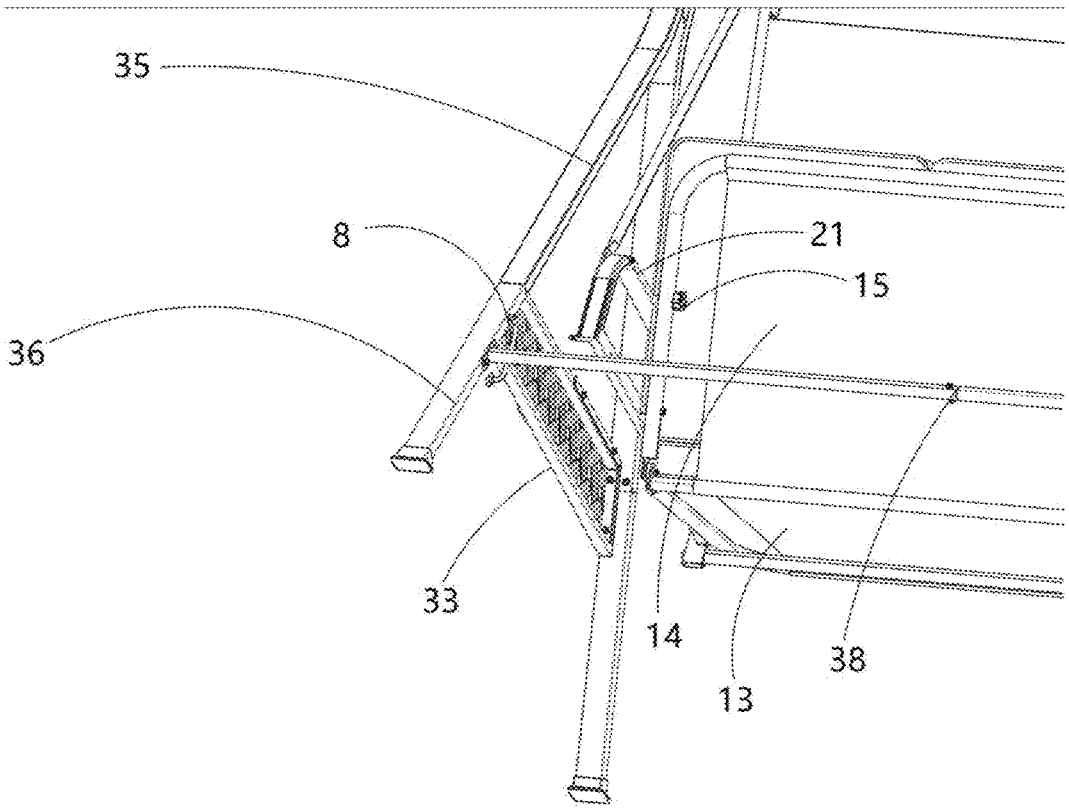
FIG. 9 is a schematic structural diagram of a hanging chair and a hanging rod.
Figure 10:
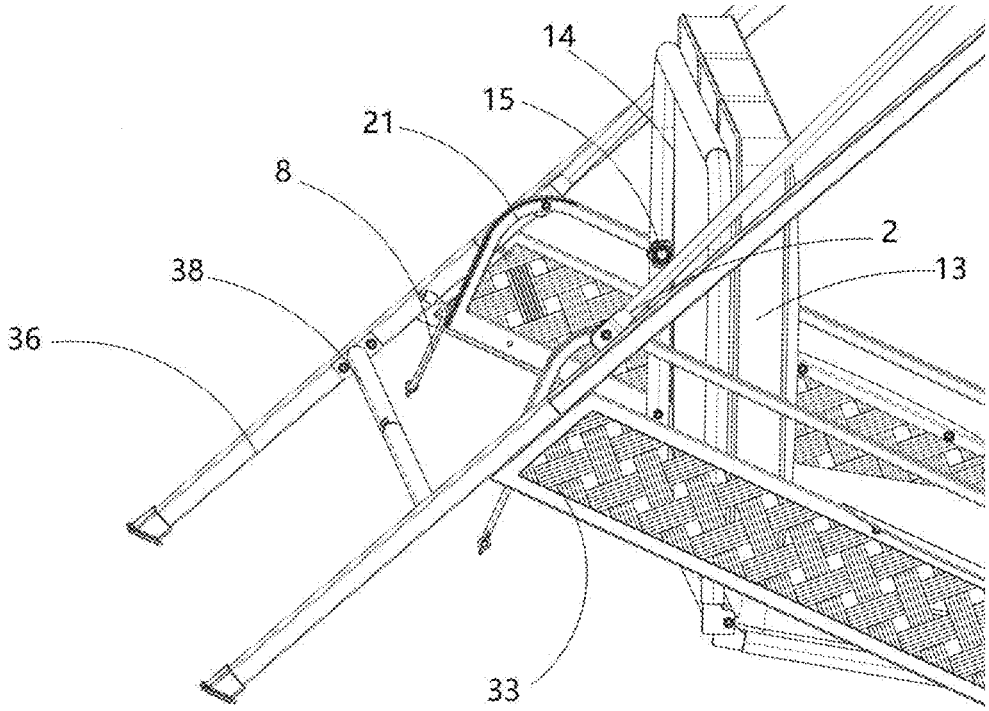
FIG. 10 is a schematic structural diagram of a rear side in FIG. 1.

In this embodiment, as shown in FIG. 7 and FIG. 9, this embodiment provides a swing chair, including a fixed hole 37 arranged on an inner side of a lower section support rod 36 in a rear support frame 32, one end of a locking rod 8 nested in the fixed hole 37, and the other end of the locking rod 8 nested in a fixed through hole 141 arranged on the backrest frame 14. The locking rod 8 is in a Z shape, one end of the locking rod sleeved on the fixed hole 37 only rotates, and one end of the locking rod sleeved on the fixed through hole 141 can be opened through a butterfly nut 81, so as to prevent the backrest frame 14 from rising and the hanging chair 1 from being integrally fixed and swinging. A fixed hole 37 is arranged on an inner side of the lower section support rod 36, one end of a locking rod 8 is nested in the fixed hole 37, and the other end of the locking rod 8 is nested in a fixed through hole 141 arranged on the backrest frame 14. The locking rod 8 is arranged to fix the hanging chair, so that the hanging chair cannot shake. The locking rod 8 is in a Z shape, one end of the locking rod sleeved on the fixed hole 37 only rotates, and one end of the locking rod sleeved on the fixed through hole 141 can be fixed through a butterfly nut 81. The user removes the butterfly nut 81 to enable the locking rod to be in a straightened and released state, and when the user needs to fix the hanging chair, the locking rod is straightened, and after a hook penetrates into the fixed through hole 141, the butterfly nut 81 is rotated to be fixed. When the user releases the hanging chair, the butterfly nut 81 is rotated to exit one end of the locking rod 8, the other end of the locking rod rotates in the fixed hole, but does not fall off, and then the butterfly nut is fitted onto the locking rod. According to the embodiment of the present invention, the locking rod is innovatively designed, and the usage function of the hanging chair is increased. Meanwhile, the hanging chair is fixed, and other potential safety hazards are prevented from being caused when the elderly, children and people with reduced mobility take. Compared with Embodiment 1, a structure, a size, a positional relationship and a connection relationship of other parts in Embodiment 3 are the same as those in Embodiment 1.

Embodiment 4

Figure 11:
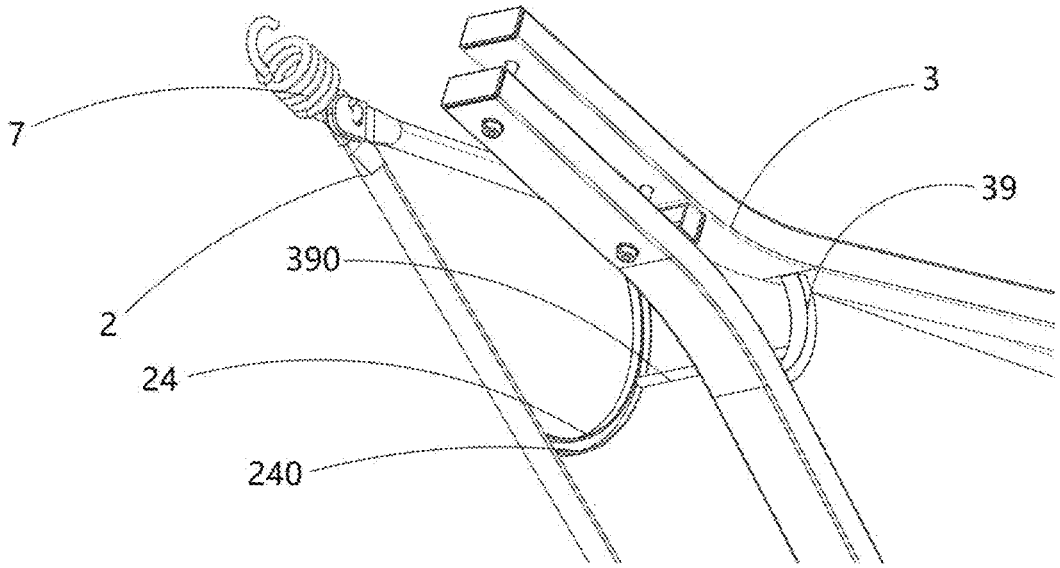
FIG. 11 is a schematic structural diagram of a limiting device.

As shown in FIG. 11, this embodiment provides a swing chair, including a U-shaped beam 39 arranged between the front support frame 31 and the rear support frame 32 in the support frame 3, one end of a limiting rod 390 fixedly arranged in a middle portion of the U-shaped beam 39, and the other end of the limiting rod 390 embedded into a limiting groove 240. The two hanging rods 2 form a herringbone shape, a limiting beam 24 is fixedly arranged between the two hanging rods 2, a limiting groove 240 is arranged on an inner side surface of the limiting beam 24, and the limiting groove 240 is adapted to sliding of the limiting rod 390. The hanging rod 2 is located on an inner side of the support frame 3. The limiting beam 24 is arranged between the hanging rods 2, the limiting groove 240 is arranged on an inner side surface of the limiting beam 24, the limiting groove 240 is adapted to one end of a body of the limiting rod 390, and the other end of the limiting rod is fixed to the U-shaped beam 39, and when the hanging chair swings, the limiting groove in the hanging rod limiting beam is adapted to the sliding of an end head of the limiting rod on the U-shaped beam 39, so that the swing amplitude is limited. The U-shaped beam and the limiting beam are respectively arranged between the support frame and the hanging rod, the limiting rod on the U-shaped beam is adapted to the limiting groove on the limiting beam, when the hanging chair swings, the limiting rod moves in the limiting groove, the swing angle and amplitude of the hanging chair are limited, so that the safety coefficient of the hanging chair during swinging is increased. Compared with Embodiment 1, a structure, a size, a positional relationship and a connection relationship of other parts in Embodiment 4 are the same as those in Embodiment 1.

Finally, it should be noted that the above embodiments are only used to illustrate the technical solutions of the present invention rather than limiting thereto. Although the present invention has been described in detail with reference to the foregoing embodiments, those of ordinary skill in the art should understand that the technical solutions recited in the foregoing embodiments may still be modified, or some or all of the technical features thereof may be replaced with equivalents. These modifications or replacements do not make the essence of the corresponding technical solution deviate from the scope of the technical solutions in the embodiments of the present invention.

What is claimed is:

1. A swing chair, comprising a ceiling (4), wherein the ceiling (4) is fixed through a support frame (3), four bottom portions of the support frame (3) are embedded in a foot pad blocks (6) respectively, two ends of a hanging chair (1) are hoisted through hanging rods (2), an upper end of each hanging rod (2) is connected to an inclined beam (43) in the ceiling (4) through a hanging spring (7); and a front support frame (31) and a rear support frame (32) are connected through a cross beam (38) to form the support frame (3) and are both detachable from the cross beam (38), wherein the two hanging rods (2) form an A shape, a limiting beam (24) is fixedly arranged between the two hanging rods (2), a limiting groove (240) is arranged on an inner side surface of the limiting beam (24), and the limiting groove (240) is adapted to allow a limiting rod (390) slide within the limiting groove (240).

2. The swing chair according to claim 1, wherein the support frame (3) is formed in an A shape by the front support frame (31) and the rear support frame (32), the front support frame (31) and the rear support frame (32) of the support frame have the same size and structure; and the front support frame (31) further comprises an upper section support rod (35) and a lower section support rod (36) which are assembled with each other in a nested manner and are fixed through a screw rod.

3. The swing chair according to claim 1, wherein a longitudinal mesh plate (33) is arranged between the front support frame (31) and the rear support frame (32), a placing plate (34) is arranged at a top portion of the longitudinal mesh plate (33), and two ends of the longitudinal mesh plate (33) are respectively connected to the front support frame (31) and the rear support frame (32) through screw rods.

4. The swing chair according to claim 1, wherein a ceiling frame (41) is arranged in the ceiling (4), the ceiling frame (41) is transversely supported through a ceiling cross beam (42), vertical beams (44) are arranged below two ends of the ceiling cross beam (42), each vertical beam (44) is fixed between the front support frame (31) and the rear support frame (32) through a screw rod in an abutting manner, an inclined beam (43) is arranged in an included angle between the vertical beam (44) and the ceiling cross beam (42), and the hanging spring (7) is fixed by the inclined beam (43).

5. The swing chair according to claim 1, wherein the two hanging rods (2) form an A shape and are respectively fixed to a side hanging frame (21) through a hole (23), the side hanging frame (21) is of an inverted U shape, and a hanging frame cross beam (22) for supporting is arranged in the side hanging frame (21).

6. The swing chair according to claim 1, wherein a U-shaped beam (39) is arranged between the front support frame (31) and the rear support frame (32) in the support frame (3), one end of the limiting rod (390) is fixedly arranged in a middle portion of the U-shaped beam (39), and the other end of the limiting rod (390) is embedded into a limiting groove (240).

* * * * *